US008686642B2

(12) United States Patent
Muray et al.

(10) Patent No.: US 8,686,642 B2
(45) Date of Patent: Apr. 1, 2014

(54) STABILIZED HIGH BRIGHTNESS LED SUITABLE AS CALIBRATION STANDARD

(76) Inventors: Andrew Julius Muray, Portland, OR (US); Robin Lynn Teitzel, Portland, OR (US)

( * ) Notice: Subject to any disclaimer, the term of this patent is extended or adjusted under 35 U.S.C. 154(b) by 299 days.

(21) Appl. No.: 12/780,652

(22) Filed: May 14, 2010

(65) Prior Publication Data

US 2011/0279036 A1 Nov. 17, 2011

Related U.S. Application Data

(60) Provisional application No. 61/178,634, filed on May 15, 2009.

(51) Int. Cl.

| | |
|---|---|
| ***H01J 7/24*** | (2006.01) |
| ***H01J 13/32*** | (2006.01) |
| ***H01J 61/52*** | (2006.01) |
| ***G05F 1/00*** | (2006.01) |
| ***H05B 37/02*** | (2006.01) |
| ***H05B 39/04*** | (2006.01) |
| ***H05B 41/36*** | (2006.01) |

(52) U.S. Cl.
USPC ..... 315/115; 315/291

(58) Field of Classification Search
None
See application file for complete search history.

(56) References Cited

U.S. PATENT DOCUMENTS

| | | | | |
|---|---|---|---|---|
| 7,423,750 | B2 * | 9/2008 | Hoshizaki et al. | 356/317 |
| 8,186,840 | B2 * | 5/2012 | Wu et al. | 362/97.1 |
| 2007/0121324 | A1 * | 5/2007 | Nakano | 362/276 |
| 2007/0273290 | A1 * | 11/2007 | Ashdown et al. | 315/113 |

* cited by examiner

*Primary Examiner* — Douglas W Owens
*Assistant Examiner* — Dedei K Hammond
(74) *Attorney, Agent, or Firm* — James L. Lund

(57) ABSTRACT

A high brightness LED (102) is precisely controlled. The temperature of the LED (102) is controlled via controlled thermal resistance (300), measurement of the base temperature (302) and careful power monitoring of the LED (102).

21 Claims, 3 Drawing Sheets

Front View

STABILIZED HIGH BRIGHTNESS LED SUITABLE AS CALIBRATION STANDARD

RELATED APPLICATION DATA

This application claims priority from U.S. provisional application Ser. No. 61/178,634 filed May 15, 2009, that we incorporate by reference.

FEDERALLY SPONSORED RESEARCH

Not Applicable

SEQUENCE LISTING OR PROGRAM

Not Applicable

FIELD OF INVENTION

This invention relates to calibration standards, specifically calibration standards for High Brightness LEDs (HBLEDs). The invention provides a stabilized light output, including both a stabilized light intensity and a stabilized light wavelength.

BACKGROUND OF THE INVENTION

LED calibration standards today use an LED which uses 20 mA of current. An example of a calibration standard today is the Inphora IPR-DES2 unit. This unit supplies about 20 mA at approximately 3V to the LED. A key attribute in a stable calibration standard is the temperature of the LED is controlled. In the Inphora IPR-DES2 unit this is done by sensing the LED voltage. The LED voltage will change depending on temperature approximately −2 mV per degree C. This is fed back to the circuit to stabilize the temperature.

LEDs will change properties over time. Observations have been made where the voltage across the LED will increase over time, even though the temperature and current are controlled. The variation over time is likely due to changes in the optically active band gap of the semiconductor. Thus a feedback system using the LED voltage will vary the controlled temperature. The rate of change of this property varies on how long the LED has been in operation. One technique to minimize this effect is to age the LED until the rate of change is low enough to tolerate.

In the Inphora IPR-DES2 unit, the LED has a power dissipation of 60 mW. The low power dissipated is adequately cooled with the surrounding environment. Since the LED temperature is above ambient, heating is the main issue, not cooling. For HBLED units the power dissipation is 3.2 W or higher; therefore more power needs to be dissipated. Thus the cooling and dissipation of the heat would be a problem with the current scheme.

The LED junction is maintained at a higher temperature than the surrounding environment. Nominally 60 degrees C. is the target temperature in the Inphora IPR-DES2 unit. By picking a temperature higher than ambient, only a heater is needed to control the temperature of the LED. The Inphora IPR-DES2 unit currently has a heater, but has no need for heat removal given the low power dissipated.

Therefore what is needed is an LED calibration standard that can dissipate the greater amount of heat generated by HBLED and provide a controlled HBLED light output that is independent of the age of the HBLED used in the standard.

BRIEF DESCRIPTION OF THE INVENTION

The present disclosure solves many of the disadvantages associated with existing LED calibration standards. Several of the many objects and advantages of the present invention are:

(a) High power LED drive, 920 mA at 3.2V (b) Precise current control, 920 mA controlled to +/1 mA (c) LED aging does not effect temperature control (d) High power (approximately 3.2 W) heat is removed effectively from the LED to allow precise control of the temperature.

(e) Cooling of the LED and moving the heat to an outside radiator without appreciably increasing temperature in the vicinity of the LED,

DRAWING

Reference Numbers

Figure 1:
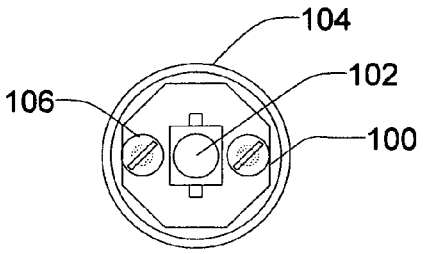
FIG. 1 is the front view of the HBLED calibration standard

100 LED board. The LED mounts to this board
102 LED
104 tube
106 mounting screw
200 2 pin connector, supplies power to LED
202 Heater board
204 Power board, supplies LED power and Heater power
206 Control board
208 Copper bar
300 controlled thermal resistance feature in copper bar
302 mounting hole for thermistor to measure base temperature of copper bar

DETAILED DESCRIPTION

Figure 2:
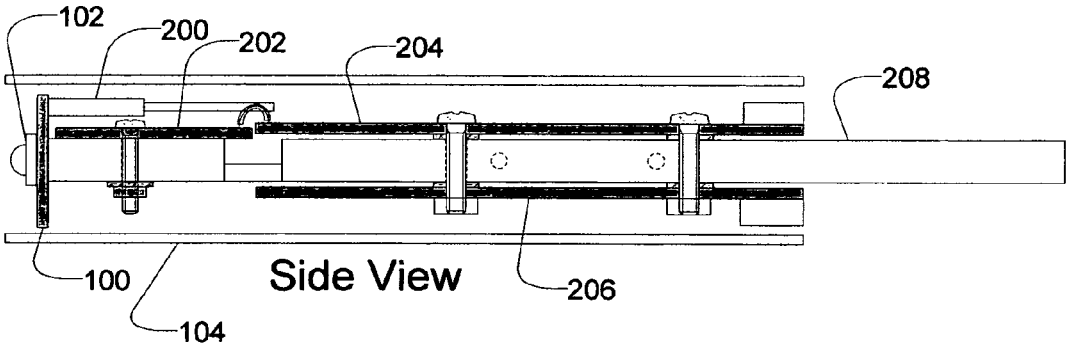
FIG. 2 is the side view of the HBLED calibration standard
Figure 3:
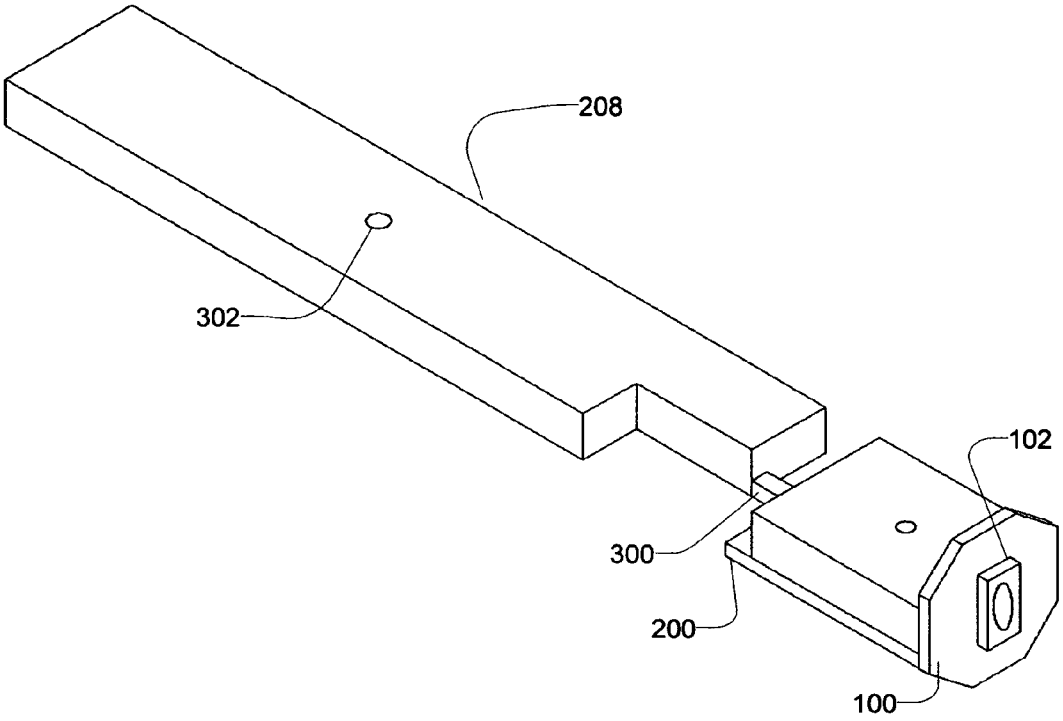
FIG. 3 shows the copper bar, the LED on the LED board, and the heater board.

A preferred embodiment of the HBLED calibration standard is illustrated in FIGS. 1-3. A tube 104 with a diameter of 25 mm is used. The current calibration standards and test fixtures are designed for 25 mm Outside Diameter (OD) tubes. The HBLED 102 is centered on a board 100. The board 100 is held to a copper bar 208 by plastic screws 106.

In the preferred embodiment the copper bar 208 is used. The bar could alternately be made of other materials such as Aluminum, but with increased thermal resistance.

In the preferred embodiment, a heater board 202 is used to generate heat. The board is composed of 8 1 ohm resistors in series. The LED board 100 is connected to the power board 204 using a 2 pin connector 200. The power board 204 provides 920 mA of current to the LED+/−2%. The power board 204 also provides the power to drive the heater board 202. The power board 204 is controlled by the control board 206. The copper bar 208 provides the thermal pathway for cooling the system. Not shown is the heatsink at the end of the copper bar providing cooling to the environment.

The copper bar 208 has a narrow feature 300 to provide controlled thermal resistance. In the preferred embodiment, the copper bar 208 has dimensions of about 0.1".times.0.177".times.0.328" in the preferred embodiment.

The feature 300 provides a controlled thermal resistance of .about.4 degree C./W. This feature's dimensions are calibrated to the amount of power dissipated by the combined LED 102 and heater board 202 to provide a controlled temperature to the LED based on the variation in room temperature through the heat sink.

The hole 302 is where a precision thermistor is placed to measure the temperature.

The mass of a copper used provides a nice damper on the system.

To control the temperature of the system, the power to the heater board 202 is controlled. The control is based on the equation:

$$P\text{heater}=(T\text{set}-T\text{cool})*K1+(P\text{set}-P\text{led})*K2$$

Pheater is the power to the heater board 202. Tset is the desired temperature at the LED 102. Tset is set to be 20 to 30 degrees higher than the maximum temperature in the room of operation. In the preferred embodiment, Tset is 60 degrees C. Tcool is the temperature measured at the hole 302. Pset is set to the maximum power the LED 102 will ever consume in any situation. The intent of (Pset-Pled) part of the equation is to cause the system to provide constant power through controlled thermal resistance feature 300. K1 is the coefficient needed to convert temperature to power. K1 is determined by the thermal resistance from the heater to the cooling base. K2 is the coefficient needed to convert the difference in power to the LED 102 and the maximum power. The coefficient K2 is only a scaling factor and the thermal resistance does not come into play.

Figure 4:
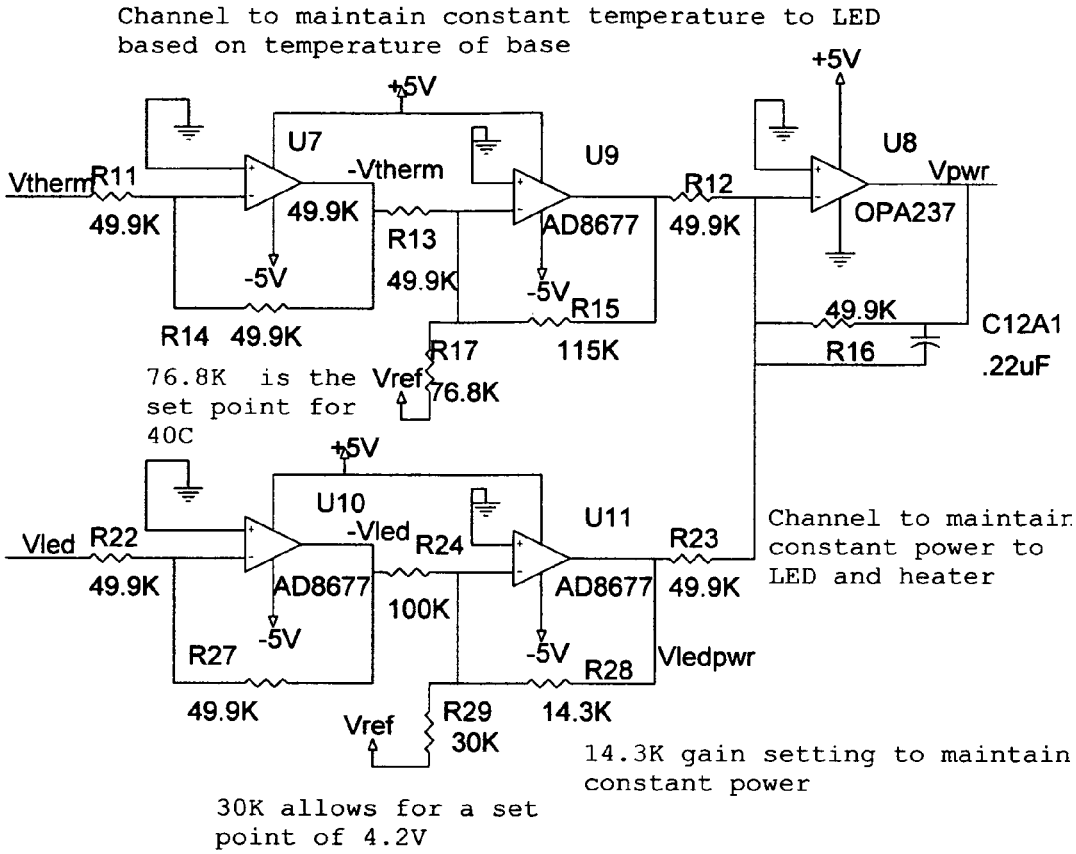
FIG. 4 is the schematic of the control system, implementing the correction equation

In the preferred embodiment, FIG. 4 is an electronic control used. The circuit implements the control as described in the above equation. The inputs are the voltage corresponding to the temperature at the hole 302 (Vtherm) and the voltage across the LED 102. The voltage across the LED 102 can be converted to the power knowing the current is set at 920 mA. The output voltage of the control system, Vpwr, varies between 0V and 1.25V. The maximum power of the heater board 202 is 8 W when Vpwr is 1.25V.

ADVANTAGES

From the description above, a number of advantages of the stabilized HBLED system become evident:

(a) The aging of the LED does not change the operational points (b) The power from the LED is removed from the area of the LED in a controlled manner (c) The unit fits into a small 25 mm tube package allowing for the continued use of current test systems.

(d) The control systems avoid temperature oscillations (e) The control system is stable

CONCLUSIONS, RAMIFICATIONS, AND SCOPE

Thus the reader will see that the stabilized HBLED unit provides a highly stabilized reliable high brightness LED useful as a laboratory standard. This invention allows the continued use of standard text fixtures with high power dissipation in the LED. Also the invention controls the temperature precisely allowing the LED to operate in a consistent manner.

Although the description above contains many specificities, these should not be construed as limiting the scope of the invention but merely providing illustration of some of the presently preferred embodiments of this invention. For example the control system could be implemented in a microprocessor. As another example the shape and size of the thermal resistance feature could be changed if the power consumed in the LED is changed. The size of the thermal resistance feature could be varied if the set point is changed, etc.

Thus the scope of the invention should be determined by the appended claims and their legal equivalents, rather than by the examples given.

We claim:

1. A system for controlling light emission from a light emitting diode (LED) of an LED calibration standard comprising:

an LED mount;

a controlled heat source in thermal communication with the LED mount;

a base;

a thermal resistance feature that constricts heat flow between the LED mount and the base; and a controller that precisely controls the amount of power to the LED mount of the LED calibration standard.

2. The system of claim 1, wherein the system is housed within a cylindrical tube that has an outer diameter of about 25 millimeters.

3. The system of claim 1, wherein the controller is configured to precisely control the electrical current supplied to the LED mount based upon a measured LED voltage to correct for LED aging processes.

4. The system of claim 1, wherein the LED mount comprises multiple LED lighting fixtures.

5. The system of claim 1, wherein the system accurately controls a light intensity and a light color emitted from one or more LEDs.

6. The system of claim 5, further comprising:

one or more LEDs, wherein each LED is an HBLED having an optical power output greater than 500 lumens.

7. The system of claim 1, wherein the controller also precisely controls the temperature of the LED mount.

8. A light emitting diode (LED) calibration standard comprising:

an LED mount;

a controlled heat source in thermal communication with the LED mount;

a heat sink;

a thermal resistance feature that provides a thermal conduction pathway between the LED mount and the heat sink; and a controller for controlling the amount of heat generated by the controlled heat source of the LED calibration standard.

9. The light emitting diode (LED) calibration standard of claim 8, further comprising:

a light emitting diode (LED) attached to the LED mount.

10. The light emitting diode (LED) calibration standard of claim 9, wherein the light emitting diode is a high brightness light emitting diode.

11. The light emitting diode (LED) calibration standard of claim 8, further comprising:

a temperature sensor attached to the heat sink.

12. The light emitting diode (LED) calibration standard of claim 8 wherein the controller is one of a circuit and a microprocessor.

13. The light emitting diode (LED) calibration standard of claim 8, wherein the thermal resistance feature constricts the flow of heat between the LED mount and the heat sink.

14. The light emitting diode (LED) calibration standard of claim 8, wherein the controller is configured to control, within a range of 2%, the electrical current supplied to the LED mount based upon a measured LED voltage to correct for LED aging processes.

15. A method of maintaining a constant light emission from an LED in an LED calibration standard comprising:

maintaining an LED at a constant temperature;

measuring a voltage across the LED;

supplying a precisely controlled electrical current to the LED to provide a constant power to the LED, based upon the measured voltage, to account for LED aging of the LED in the LED calibration standard.

16. The method of claim 15, wherein the supplying is also based upon the LED temperature.

17. The method of claim 15, wherein the supplying of the current is controlled within a range of +/−2%.

18. The method of claim 15, wherein the supplying of the current is controlled within a range of +/−1 mA.

19. The method of claim 15, wherein the maintaining the LED at a constant temperature further comprises measuring a temperature of a base in thermal communication with the LED.

20. The method of claim 19, further comprising constricting the heat flow from the LED to the base, wherein the base acts as a heat sink.

21. The method of claim 20, wherein the constricting of the heat flow provides a thermal resistance of about 4 degrees C.

* * * * *